US009090067B2

(12) United States Patent
Ohsumi et al.

(10) Patent No.: US 9,090,067 B2
(45) Date of Patent: Jul. 28, 2015

(54) METHOD FOR MANUFACTURING LIQUID DISCHARGE HEAD

(71) Applicant: CANON KABUSHIKI KAISHA, Tokyo (JP)

(72) Inventors: Masaki Ohsumi, Yokosuka (JP); Kenji Fujii, Yokohama (JP); Koji Sasaki, Nagareyama (JP); Ryotaro Murakami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/538,660

(22) Filed: Nov. 11, 2014

(65) Prior Publication Data

US 2015/0129542 A1 May 14, 2015

(51) Int. Cl.
*B41J 2/14* (2006.01)
*B41J 2/16* (2006.01)

(52) U.S. Cl.
CPC ..... *B41J 2/1639* (2013.01); *B41J 2/1607* (2013.01); *B41J 2/1623* (2013.01); *B41J 2/1626* (2013.01)

(58) Field of Classification Search
USPC ..... 216/27, 41, 58, 83
See application file for complete search history.

(56) References Cited

U.S. PATENT DOCUMENTS

| | | | | |
|---|---|---|---|---|
| 6,960,424 | B2 * | 11/2005 | Miyagawa et al. | 430/320 |
| 2009/0136875 | A1 * | 5/2009 | Kubota et al. | 430/320 |
| 2011/0151598 | A1 * | 6/2011 | Abo et al. | 438/21 |
| 2013/0017496 | A1 * | 1/2013 | Matsumoto et al. | 430/320 |

FOREIGN PATENT DOCUMENTS

JP 2006-224598 A 8/2006

* cited by examiner

*Primary Examiner* — Shamim Ahmed
(74) *Attorney, Agent, or Firm* — Canon USA Inc. IP Division

(57) ABSTRACT

There is provided a method for manufacturing a liquid discharge head including a substrate in which a liquid supply port is formed, a channel forming member that forms a liquid channel communicating with the liquid supply port on the substrate. The method includes preparing a substrate on which a hole serving as the liquid supply port is open, attaching a dry film on the substrate to cover an opening of the hole with the dry film, curing a cover part of the dry film that covers the hole, patterning the dry film to form a mold for the liquid channel, of a region of the dry film that includes the cover part, forming the channel forming member such that it covers the mold, and removing the mold to form the liquid channel.

9 Claims, 6 Drawing Sheets

METHOD FOR MANUFACTURING LIQUID DISCHARGE HEAD

BACKGROUND OF THE INVENTION

1. Field of the Invention

The present invention relates to a method for manufacturing a liquid discharge head.

2. Description of the Related Art

A liquid discharge head is used in a liquid discharge apparatus such as an ink-jet recording apparatus, and has a channel forming member and a substrate. The channel forming member is formed of resin or the like on the substrate, that is, on the front surface side of the substrate. Inside the channel forming member, a liquid channel is formed, and sometimes discharge ports communicating with the liquid channel are further formed. A liquid supply port penetrating the substrate is formed in the substrate.

As a method for manufacturing such a liquid discharge head, there has been a method in which a mold for a liquid channel and a channel forming member are formed on a substrate, and then a liquid supply port is formed in the substrate by etching or the like. In this method, in the step of forming a mold for a liquid channel and a channel forming member on the substrate, a liquid supply port is not yet formed in the substrate. That is, the front surface of the substrate can be made flat. Therefore, for example, such a problem can be prevented from occurring that a mold for a liquid channel to be formed just above a liquid supply port sags into a hole serving as a liquid supply port and, as a result, a liquid channel is deformed.

However, in this method, in the step of forming a liquid supply port in the substrate, a mold for a liquid channel and a channel forming member are already formed on the substrate. Therefore, the mold for a liquid channel and the channel forming member need to be protected from etchant or the like forming a liquid supply port, with a protective film or the like, and the manufacturing process is thereby complicated.

So, as a method for manufacturing a liquid discharge head, a method is possible in which a hole serving as a liquid supply port is formed in a substrate, and then a mold for a liquid channel and a channel forming member are formed on the substrate. In this method, since the protection of the mold for a liquid channel and the channel forming member when forming a liquid supply port is unnecessary, the manufacturing process is simplified. However, such a problem may occur that the mold for a liquid channel formed just above the liquid supply port sags into the hole serving as a liquid supply port and, as a result, a liquid channel is deformed.

To solve such a problem, Japanese Patent Laid-Open No. 2006-224598 describes forming a beam on the front surface side of a substrate so that a mold can be prevented from sagging into a liquid supply port by the beam.

SUMMARY OF THE INVENTION

An aspect of the present invention is a method for manufacturing a liquid discharge head including a substrate in which a liquid supply port is formed, a channel forming member that forms a liquid channel communicating with the liquid supply port on the substrate. The method includes preparing a substrate on which a hole serving as the liquid supply port is open, attaching a dry film on the substrate to cover an opening of the hole with the dry film, curing a cover part of the dry film that covers the hole, patterning the dry film to form a mold for the liquid channel, of a region of the dry film that includes the cover part, forming the channel forming member such that it covers the mold, and removing the mold to form the liquid channel.

Further features of the present invention will become apparent from the following description of exemplary embodiments with reference to the attached drawings.

DESCRIPTION OF THE EMBODIMENTS

In the method described in Japanese Patent Laid-Open No. 2006-224598, a beam needs to be formed on the front surface side of a substrate. Therefore, the manufacturing process is thereby complicated.

Therefore, the present invention provides a method for manufacturing a liquid discharge head in which, even in a case where a hole serving as a liquid supply port is formed in a substrate and then a mold for a liquid channel is formed on the substrate, the mold for a liquid channel can be easily prevented from sagging into the hole serving as a liquid supply port and being deformed.

Figure 1:
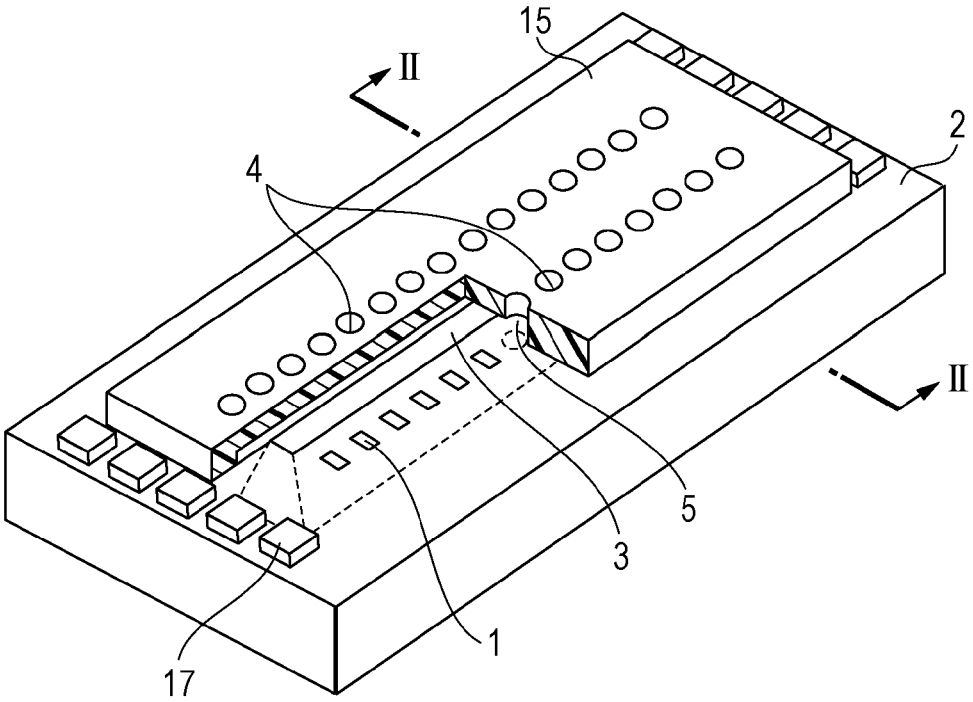
FIG. 1 is a diagram showing an example of a liquid discharge head manufactured by the present invention.

An example of a liquid discharge head manufactured by the present invention is shown in FIG. 1. The liquid discharge head has a substrate 2 having energy generating elements 1 and a channel forming member 15 forming a liquid channel 5 and discharge ports 4.

Examples of the energy generating elements 1 include heating resistors and piezoelectric elements. The energy generating elements may be formed so as to be in contact with the front surface of the substrate, or may be formed in a hollow shape so as to be partly out of contact with the front surface of the substrate.

Examples of the substrate 2 include a silicon substrate formed of silicon. The above-described energy generating elements 1 are formed on a first surface (front surface) side of the substrate. The first surface and a second surface (back surface) that is a surface on the side opposite to the first surface can have a silicon crystal plane orientation of (100). That is, the substrate 2 can be a (100) substrate formed of silicon.

A liquid supply port 3 is formed in the substrate 2. The liquid supply port 3 is formed so as to penetrate the substrate from the first surface to the second surface. The energy generating elements 1 are formed on the first surface side of the substrate so as to be arranged in two lines on both sides of the opening of the liquid supply port 3. In addition to these, an insulating film, a cavitation resistant film, and the like (not shown) are formed on the substrate 2.

The channel forming member 15 is formed of resin or the like. The channel forming member 15 forms the liquid channel 5 and the discharge ports 4, and the discharge ports 4 are disposed at positions corresponding to the energy generating elements 1. The liquid supply port 3 and the liquid channel 5 communicate with each other. Liquid is supplied from the liquid supply port 3 to the liquid channel 5, is given energy by the energy generating elements 1, and is discharged from the discharge ports 4. There are terminals (bumps) 17 at both ends of the substrate 2. By electrically connecting the terminals 17 and a liquid discharge apparatus, the energy generating elements are electrically connected through the terminals to the outside, and can generate energy.

Next, a method for manufacturing a liquid discharge head of the present invention will be described with reference to FIGS. 2A to 21. FIGS. 2A to 21 are sectional views taken along line II-II of FIG. 1.

Figure 2A:
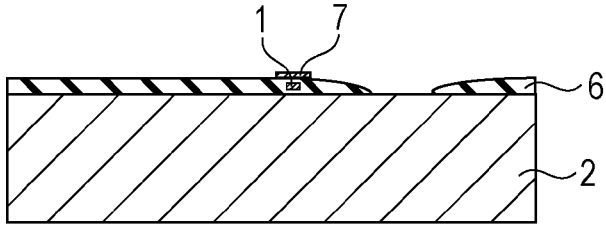
FIGS. 2A to 2I are diagrams showing an example of a method for manufacturing a liquid discharge head of the present invention.

First, as shown in FIG. 2A, a substrate 2 is prepared. The first surface side of the substrate 2 is covered with an insulating film 6. The insulating film 6 is formed, for example, of $SiO_2$ or SiN. The insulating film 6 covers the energy generating elements 1, but, as shown in FIG. 2A, does not exist on a part of the substrate 2. A cavitation resistant film 7 is formed over the energy generating elements 1. The cavitation resistant film 7 is formed, for example, of tantalum.

Figure 2B:
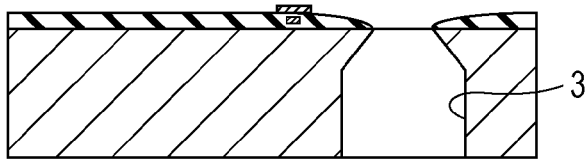

Next, as shown in FIG. 2B, a hole serving as a liquid supply port 3 is formed in the substrate 2. Methods for forming a liquid supply port 3 include dry etching such as reactive ion etching, laser irradiation, and wet etching using etchant. The formation of a hole serving as a liquid supply port 3 can be performed from the second surface side of the substrate 2. For example, when performing wet etching using etchant, a mask that has etching resistance and in which an opening is formed is formed on the second surface side of the substrate. Then, etchant is introduced through the opening of the mask. Thereby, the substrate 2 is etched, and a hole serving as a liquid supply port 3 is formed from the second surface side of the substrate 2. Etchants used for wet etching include a TMAH (tetramethylammonium hydroxide) solution and a KOH (potassium hydroxide) solution. Wet etching can be anisotropic etching of silicon. The hole serving as a liquid supply port 3 penetrates the substrate 2, and is open on the first surface side of the substrate 2.

Figure 2C:
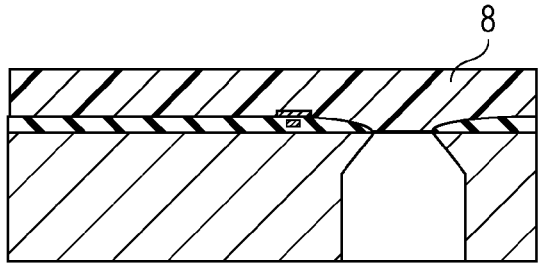

After preparing the substrate 2 on which the hole serving as a liquid supply port is open in this way, a dry film 8 is attached to the first surface side of the substrate 2 as shown in FIG. 2C. Wiring and the like are formed on the first surface side of the substrate 2, and so the first surface side of the substrate 2 is not completely flat. Therefore, if the dry film 8 is attached to the first surface of the substrate 2 in the atmosphere, bubbles are generated between the first surface of the substrate 2 and the dry film 8, and this may lead to deformation of the liquid discharge head. Therefore, the dry film 8 can be attached in a vacuum. By attaching the dry film 8 on the substrate, the opening of the hole serving as a liquid supply port 3 is covered with the dry film 8.

Next, curing and patterning of the dry film 8 are performed. Curing and patterning of the dry film 8 may be performed in any order, or may be performed in the same step. The dry film 8 is cured at least in a cover part thereof that covers the hole. Curing of the dry film 8 may be photo-curing or thermal curing. Curing the dry film 8 means increasing the hardness of the dry film 8 by irradiating the dry film 8 with light or heating the dry film 8.

Figure 2D:
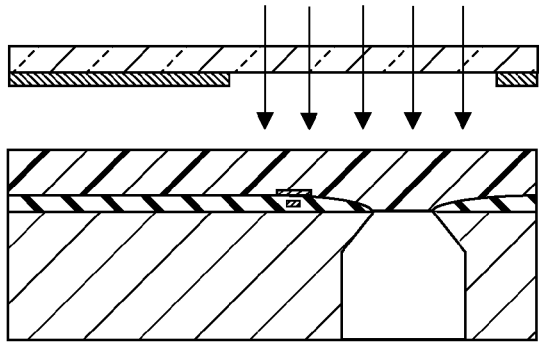
Figure 2E:
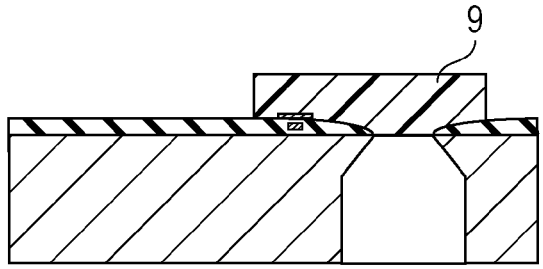

A description will be given, for example, of a case where negative photosensitive resin is used as the dry film 8. In this case, by performing pattern exposure as shown in FIG. 2D, an exposed part can be cured, and an unexposed part can not be cured. The unexposed part can be removed using a solvent or the like as shown in FIG. 2E. The exposed part of the dry film 8 is a region over the hole serving as a liquid supply port, that is, a cover part that covers the hole serving as a liquid supply port, and this cover part is cured. As described above, if negative photosensitive resin is used as the dry film 8, a cover part of the dry film 8 that covers the hole serving as a liquid supply port can be cured in the step of patterning the dry film 8.

In consideration of photo-curing the dry film 8, the dry film 8 can be formed of a photo-curable acrylic resin. A photo-curable acrylic resin is also superior in removability. When the dry film 8 is formed of a photosensitive resin, a negative photosensitive resin can be used. If the dry film 8 is formed of a negative photosensitive resin, the rigidity of the dry film 8 is easily increased by photo-curing, and the dry film 8 is easy to cure.

In consideration of thermally curing the dry film 8, the dry film 8 can be formed of a thermally curable acrylic resin containing an epoxy group-containing resin. Thermal curing is performed by heating the dry film. The heating temperature in this case is preferably higher than or equal to 120° C. and lower than or equal to 150° C.

As described above, curing and patterning of the dry film 8 may be performed in any order. For example, the dry film 8 is patterned by dry etching or the like, and then a cover part of the dry film 8 that covers the hole serving as a liquid supply port 3 is cured. Alternatively, after curing the whole of the dry film 8, the dry film is patterned, and the cover part is left.

In the present invention, the dry film 8 is patterned, and a region of the dry film that includes the cover part forms a mold for a liquid channel. By curing the cover part, the mold can be prevented from sagging into the liquid supply port, being deformed, and thereby deforming a liquid supply port. The mold can also be prevented from being deformed by vacuum pressure when vacuum suction is performed.

The thickness of the dry film 8 is preferably more than or equal to 3 μm and less than or equal to 30 μm. By making the thickness of the dry film 8 more than or equal to 3 μm, the dry film 8 can be prevented more effectively from sagging into the liquid supply port, and being deformed. By making the thickness of the dry film 8 less than or equal to 30 μm, the curing time and the removal time can be shortened.

Figure 2F:
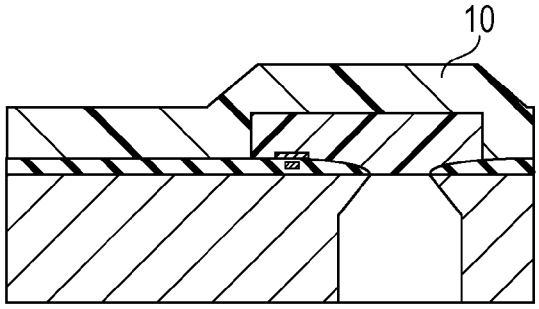

Next, as shown in FIG. 2F, a photosensitive resin layer 10 serving as a channel forming member 15 is formed so as to cover the mold 9. The photosensitive resin layer is formed, for example, by applying a coating liquid containing a negative photosensitive resin. In the present invention, even if a coating liquid is applied, since the mold 9 obtained by curing the dry film exists, the coating liquid can be prevented from flowing into the hole serving as a liquid supply port. Although a description has been given using an example where a channel forming member is formed of a photosensitive resin, a channel forming member may be formed of a non-photosensitive resin, or an inorganic film of SiN, SiC, or the like.

Figure 2G:
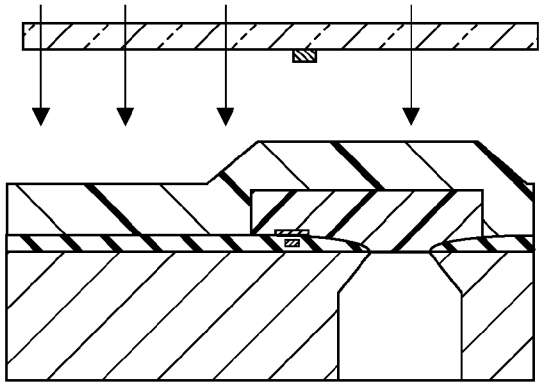
Figure 2H:
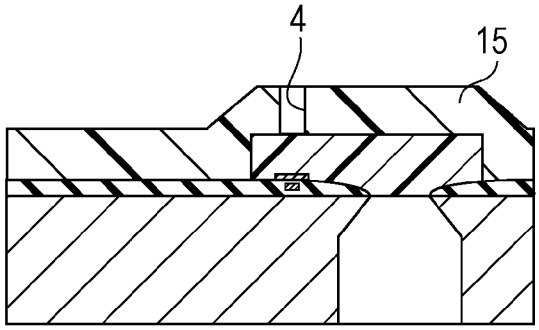

Next, as shown in FIG. 2G, discharge ports 4 are formed in the channel forming member. Here, since the channel forming member is a photosensitive resin layer 10, the photosensitive resin layer 10 is pattern-exposed. Then, as shown in FIG. 2H, the photosensitive resin layer 10 is developed with a solvent or the like to form discharge ports 4 in the photosensitive resin layer 10. Discharge ports 4 can also be formed by laser irradiation or reactive ion etching.

Figure 2I:
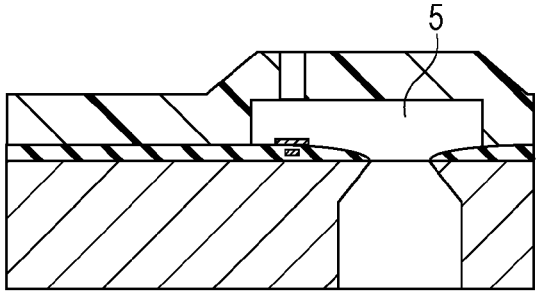

Next, as shown in FIG. 2I, the mold 9 is removed using a solvent or the like. Thereby, a liquid channel 5 is formed inside the photosensitive resin layer 10. That is, the photosensitive resin layer 10 becomes a channel forming member 15.

After that, the substrate 2 is separated with a dicing saw or the like as needed, the energy generating elements 1 are electrically joined, and thus a liquid discharge head is manufactured.

Although an example has been described where a mold for a liquid channel is formed of a layer (sheet) of dry film, a mold for a liquid channel may be formed of, in addition to a layer of dry film, another dry film. Alternatively, a mold for a liquid channel may be formed of, in addition to a layer of negative dry film, a member formed of another material. This example will be described with reference to FIGS. 3A to 3L below.

Figure 3A:
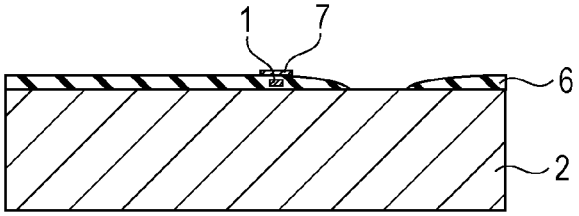
FIGS. 3A to 3L are diagrams showing an example of a method for manufacturing a liquid discharge head of the present invention.
Figure 3B:
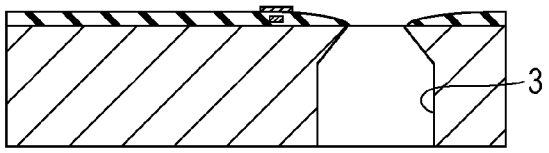

First, as shown in FIG. 3A and FIG. 3B, a liquid supply port 3 is formed in a substrate 2. The steps thereof are the same as those described with reference to FIG. 2A and FIG. 2B.

Figure 3C:
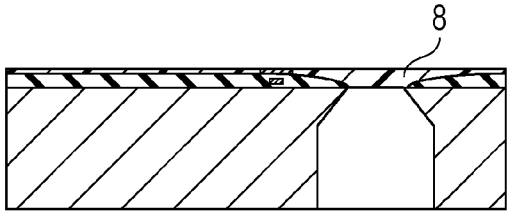

After preparing a substrate on which a hole serving as a liquid supply port is open in this way, a dry film 8 is attached to the first surface side of the substrate 2 as shown in FIG. 3C. The attachment itself of a dry film is the same as that described with reference to FIG. 2C. However, in FIG. 3C, the dry film 8 is formed thin as needed. In this case, the thickness of the dry film 8 is preferably more than or equal to 3 μm and less than or equal to 20 μm. The dry film 8 can be attached to the first surface of the substrate 2 in a vacuum. By attaching the dry film on the substrate, the opening of the hole serving as a liquid supply port is covered.

Figure 3D:
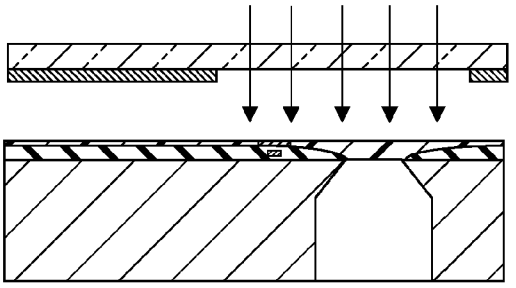
Figure 3E:
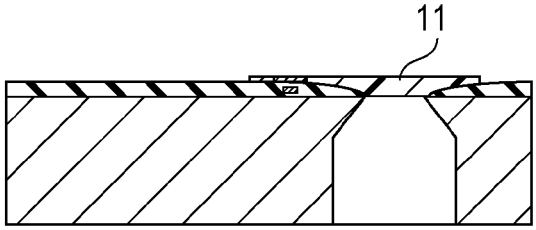

Next, as shown in FIG. 3D and FIG. 3E, curing and patterning of the dry film 8 are performed. The steps thereof are also the same as those described with reference to FIG. 2D and FIG. 2E. Thereby, the cover part of the dry film 8 is cured, and this part serves as a first mold 11 for a liquid channel.

Figure 3F:
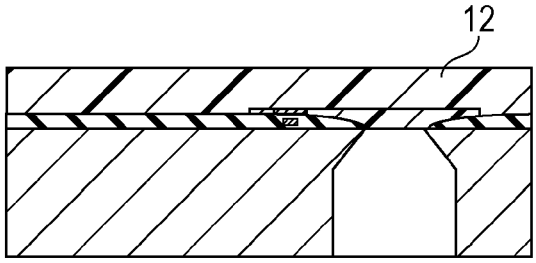

Next, as shown in FIG. 3F, a photosensitive resin layer 12 is formed over the first mold 11. The photosensitive resin layer 12 may be a positive photosensitive resin layer containing a positive photosensitive resin or a negative photosensitive resin layer containing a negative photosensitive resin. The photosensitive resin layer 12 may be formed of a coating liquid containing a photosensitive resin or may be formed of a dry film obtained by drying a coating liquid.

Figure 3G:
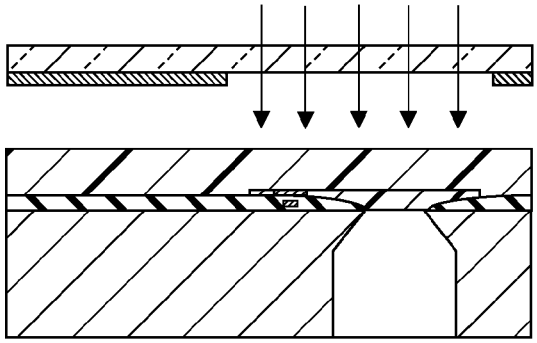
Figure 3H:
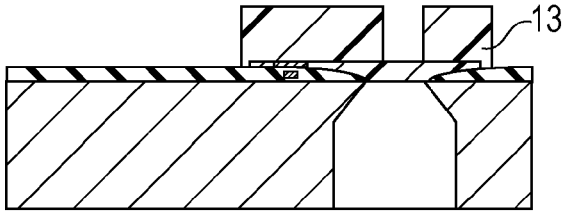

Next, as shown in FIG. 3G, the photosensitive resin layer 12 is pattern-exposed. Then, as shown in FIG. 3H, the photosensitive resin layer 12 is developed with a solvent or the like. The photosensitive resin layer 12 after development serves as a second mold 13 that is a part of a mold for a liquid channel. In FIG. 3H, an example is shown where a space is formed so as to divide the second mold 13 by pattern exposure and development. Afterward, a wall 16 described later is formed in this space.

Figure 3I:
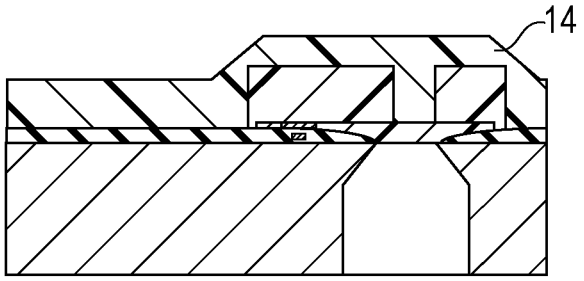

Next, as shown in FIG. 3I, a photosensitive resin layer 14 serving as a channel forming member 15 is formed so as to cover the first mold 11 and the second mold 13 that are molds for a liquid channel. The photosensitive resin layer 14 and the channel forming member 15 are the same as those described with reference to FIG. 2F.

Figure 3J:
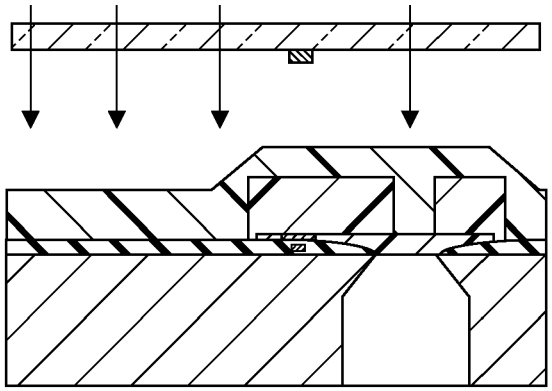
Figure 3K:
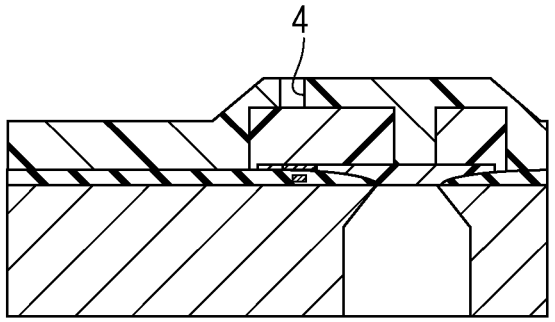

Next, as shown in FIG. 3J, discharge ports 4 are formed in the photosensitive resin layer 14 serving as a channel forming member. Then, as shown in FIG. 3K, the photosensitive resin layer 14 is developed with a solvent or the like to form discharge ports 4 in the photosensitive resin layer 14. Discharge ports 4 can also be formed by laser irradiation or reactive ion etching.

Figure 3L:
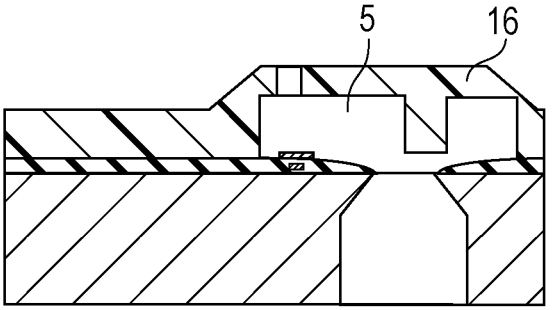

Next, as shown in FIG. 3L, the first mold 11 and the second mold 13 are removed using a solvent or the like. Thereby, a liquid channel 5 is formed inside the photosensitive resin layer 14. That is, the photosensitive resin layer 14 becomes a channel forming member 15.

After that, the substrate 2 is separated with a dicing saw or the like as needed, the energy generating elements 1 are electrically joined, and thus a liquid discharge head is manufactured.

The first mold 11 and the second mold 13 can be simultaneously removed using a solvent or the like. In this respect, the first mold 11 and the second mold 13, in other words, the dry film 8 and the photosensitive resin layer 12 can be formed of the same type of photosensitive resins. "The same type" means that the basic structures of resins are the same, and does not mean that the molecular weights or the like of resins are exactly equal. When the first mold 11 and the second mold 13 are not simultaneously removed, for example, a method can be used in which the second mold 13 is removed by dry etching, and then the first mold 11 is removed by wet etching.

As described above, in FIG. 3G and FIG. 3H, when pattern-exposing and developing the photosensitive resin layer 12, a space is formed in the second mold 13 formed of the photosensitive resin layer 12. Thereby, in FIG. 3I, the photosensitive resin layer 14 can be introduced into the formed space, and this part finally serves as the wall 16 shown in FIG. 3L. By forming the wall 16, interference of energy between liquid channels when discharging liquid can be prevented. When forming the wall 16, the photosensitive resin layer 14 can be formed of a coating liquid containing a photosensitive resin.

EXAMPLES

Next, the present invention will be described more specifically with reference to examples.

Example 1

First, as shown in FIG. 2A, a (100) substrate formed of silicon was prepared as a substrate 2. An insulating film 6 of $SiO_2$ and a cavitation resistant film 7 of tantalum were formed on the substrate 2.

Next, an etching mask was formed of polyether amide on the second surface side of the substrate 2, and 22 mass % of TMAH solution was introduced through the opening of the etching mask. After that, the etching mask was removed. Thereby, as shown in FIG. 2B, a hole serving as a liquid supply port 3 was formed in the substrate 2.

Next, as shown in FIG. 2C, a dry film 8 is attached to the first surface side of the substrate 2. A negative dry film (trade name: KI-1000, manufactured by Hitachi Chemical Co., Ltd.) was used as the dry film 8. The dry film 8 was attached under conditions of vacuumization, 45° C., and 0.2 MPa, and the thickness of the dry film 8 was 14 μm. By attaching the dry film 8, the opening of the hole serving as a liquid supply port 3 was covered.

Next, as shown in FIG. 2D, the dry film 8 formed on the first surface side of the substrate was pattern-exposed at 3000 $mJ/m^2$ using a stepper (trade name: FPA-3000i5+, manufactured by CANON KABUSHIKI KAISHA). As shown in FIG. 2D, a cover part of the dry film 8 that covers the hole serving as a liquid supply port was exposed. By exposure, the cover part of the dry film 8 was cured.

Next, as shown in FIG. 2E, the dry film 8 was developed using PGMEA as a solvent to form a mold 9 for a liquid channel, of the dry film 8. The mold 9 for a liquid channel is the cover part covering the hole.

Next, as shown in FIG. 2F, a photosensitive resin layer 10 serving as a channel forming member 15 was formed so as to cover the mold 9. The photosensitive resin layer was formed by applying and drying a coating liquid containing 53 mass % of epoxy resin (trade name: EHPE-3150, manufactured by Daicel Corporation), 3 mass % of photocationic polymerization initiator (trade name: SP-172, manufactured by ADEKA CORPORATION), and 44 mass % of methyl isobutyl ketone.

Next, as shown in FIG. 2G, the photosensitive resin layer 10 was pattern-exposed at 4000 $mJ/m^2$ using a stepper (trade name: FPA-3000i5+, manufactured by CANON KABUSHIKI KAISHA).

Next, as shown in FIG. 2H, the photosensitive resin layer 10 was developed using methyl isobutyl ketone to form discharge ports 4 in the photosensitive resin layer 10.

Next, as shown in FIG. 2I, the mold 9 was removed using a solvent (trade name: P3 poleve 496, manufactured by Henkel) while applying the ultrasonic wave. After that, heating at 200° C. for 60 minutes was performed to cure the channel forming member 15. Thereby, the photosensitive resin layer 10 was made a channel forming member 15.

After that, the substrate 2 was separated with a dicing saw or the like, the energy generating elements 1 were electrically joined, and thus a liquid discharge head was manufactured.

No deformation of the liquid channel was observed in the manufactured liquid discharge head, and the manufactured liquid discharge head was satisfactory.

Example 2

First, as shown in FIG. 3A and FIG. 3B, a liquid supply port 3 was formed in a substrate 2. The steps thereof were the same as those described with reference to FIG. 2A and FIG. 2B of Example 1.

Next, as shown in FIG. 3C, a dry film 8 was formed on the first surface side of the substrate 2. A negative dry film (trade name: KI-1000, manufactured by Hitachi Chemical Co., Ltd.) was used as the dry film 8. The dry film 8 was attached under conditions of vacuumization, 45° C., and 0.2 MPa, and the thickness of the dry film 8 was 5 μm. By attaching the dry film 8, the opening of the hole serving as a liquid supply port 3 was covered.

Next, as shown in FIG. 3D, the dry film 8 formed on the first surface side of the substrate was pattern-exposed at 3000 mJ/m$^2$ using a stepper (trade name: FPA-3000i5+, manufactured by CANON KABUSHIKI KAISHA). As shown in FIG. 3D, a cover part of the dry film 8 that covers the liquid supply port was exposed. By exposure, the cover part of the dry film 8 was cured.

Next, the dry film 8 was baked at 95° C. for three minutes, and as shown in FIG. 3E, the dry film 8 was developed using PGMEA as a solvent to form a first mold 11 that is a part of a mold for a liquid channel, of the dry film 8.

Next, as shown in FIG. 3F, a photosensitive resin layer 12 was formed over the first mold 11. The photosensitive resin layer 12 was formed by applying a coating liquid containing polymethyl isopropenyl ketone which is a positive photosensitive resin (trade name: ODUR, manufactured by TOKYO OHKA KOGYO Co., Ltd.) on the substrate 2 by spin coating.

Next, as shown in FIG. 3G, the photosensitive resin layer 12 was pattern-exposed with an exposure apparatus (trade name: UX3000, manufactured by USHIO INC.).

Next, as shown in FIG. 3H, the photosensitive resin layer 12 was developed using methyl isobutyl ketone and was then rinsed using isopropyl alcohol to form a second mold 13 that is a part of a mold for a liquid channel. As shown in FIG. 3H, a space was formed in the second mold 13 so as to divide the second mold 13.

Next, as shown in FIG. 3I, a photosensitive resin layer 14 serving as a channel forming member 15 was formed so as to cover the first mold 11 and the second mold 13 that are molds for a liquid channel. The photosensitive resin layer 14 was formed by applying and drying a coating liquid containing 53 mass % of epoxy resin (trade name: EHPE-3150, manufactured by Daicel Corporation), 3 mass % of photocationic polymerization initiator (trade name: SP-172, manufactured by ADEKA CORPORATION), and 44 mass % of methyl isobutyl ketone.

Next, as shown in FIG. 3J, the photosensitive resin layer 14 was pattern-exposed at 4000 mJ/m$^2$ using a stepper (trade name: FPA-3000i5+, manufactured by CANON KABUSHIKI KAISHA).

Next, as shown in FIG. 3K, the photosensitive resin layer 14 was developed using methyl isobutyl ketone to form discharge ports 4 in the photosensitive resin layer 14.

Next, as shown in FIG. 3L, the first mold 11 and the second mold 13 were simultaneously removed using a solvent (trade name: P3 poleve 496, manufactured by Henkel) while applying the ultrasonic wave. After that, heating at 200° C. for 60 minutes was performed to cure the channel forming member 15. Thereby, the photosensitive resin layer 14 was made a channel forming member 15.

After that, the substrate 2 was separated with a dicing saw or the like, the energy generating elements 1 were electrically joined, and thus a liquid discharge head was manufactured.

In the manufactured liquid discharge head, the wall 16 shown in FIG. 3L was formed. No deformation of the liquid channel was observed in the manufactured liquid discharge head, and the manufactured liquid discharge head was satisfactory.

Comparative Example 1

A dry film 8 was cured by exposure in Example 1, whereas this step was not performed in Comparative Example 1. A dry film 8 was patterned by RIE. Except for this, a liquid discharge head was manufactured in the same manner as in Example 1.

In the manufactured liquid discharge head, the upper wall of the liquid channel was sagged, and the liquid channel was slightly deformed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-234943 filed Nov. 13, 2013, which is hereby incorporated by reference herein in its entirety.

What is claimed is:

1. A method for manufacturing a liquid discharge head including a substrate in which a liquid supply port is formed, a channel forming member that forms a liquid channel communicating with the liquid supply port on the substrate, the method comprising:

preparing a substrate on which a hole serving as the liquid supply port is open;

attaching a dry film on the substrate to cover an opening of the hole with the dry film;

curing a cover part of the dry film that covers the hole;

patterning the dry film to form a mold for the liquid channel, of a region of the dry film that includes the cover part;

forming the channel forming member such that it covers the mold; and removing the mold to form the liquid channel.

2. The method for manufacturing a liquid discharge head according to claim 1, wherein the curing of the cover part is photo-curing performed by exposing the dry film.

3. The method for manufacturing a liquid discharge head according to claim 1, wherein the dry film is formed of a negative photosensitive resin.

4. The method for manufacturing a liquid discharge head according to claim 1, wherein the thickness of the dry film is more than or equal to 3 μm and less than or equal to 30 μm.

5. The method for manufacturing a liquid discharge head according to claim 1, wherein a photosensitive resin layer is formed over the cover part, the cover part serves as a first mold, the photosensitive resin layer serves as a second mold, and the mold is formed by the first mold and the second mold.

6. The method for manufacturing a liquid discharge head according to claim 5, wherein a space is formed in the second mold, the channel forming member is introduced into the space, and thereby the introduced part of the channel forming member serves as a wall between liquid channels.

7. The method for manufacturing a liquid discharge head according to claim 5, wherein the first mold and the second mold are simultaneously removed to form the liquid channel.

8. The method for manufacturing a liquid discharge head according to claim 5, wherein the first mold and the second mold are formed of the same type of photosensitive resins.

9. The method for manufacturing a liquid discharge head according to claim 1, wherein the curing of the cover part is thermal curing performed by heating the dry film.

* * * * *